US011058906B2

(12) United States Patent
Zhou et al.

(10) Patent No.: US 11,058,906 B2
(45) Date of Patent: Jul. 13, 2021

(54) SWEEPING AND FIRE EXTINGUISHING DEVICE

(71) Applicant: Zhuhai RAVV Technology Co., Ltd., Zhuhai (CN)

(72) Inventors: Maosong Zhou, Kunming (CN); Shaolun Lin, Milpitas, CA (US)

(73) Assignee: Shenzhen Qianhai Ruifu Technology Co., Ltd., Shenzhen (CN)

( * ) Notice: Subject to any disclaimer, the term of this patent is extended or adjusted under 35 U.S.C. 154(b) by 256 days.

(21) Appl. No.: 16/433,310

(22) Filed: Jun. 6, 2019

(65) Prior Publication Data

US 2020/0384294 A1 Dec. 10, 2020

(51) Int. Cl.
*A62C 13/78* (2006.01)
*A62C 27/00* (2006.01)

(52) U.S. Cl.
CPC ..... *A62C 13/78* (2013.01); *A62C 27/00* (2013.01)

(58) Field of Classification Search
CPC ..... A62C 13/78; A62C 27/00; A62C 37/40; A47L 2201/04; A47L 7/00; A47L 9/2852; A47L 9/2873; A47L 9/2805; A47L 9/2889
See application file for complete search history.

(56) References Cited

U.S. PATENT DOCUMENTS 7,182,144 B2 * 2/2007 Baba ..... A62C 27/00 169/21
8,381,826 B2 * 2/2013 Al-Azemi ..... A62C 27/00 169/52
2017/0137078 A1 * 5/2017 Tseng ..... B62D 55/14
(Continued)

FOREIGN PATENT DOCUMENTS

CN 2015-617394 * 8/2015 ..... A47L 11/38
CN 109833001 A * 6/2019 ..... A47L 11/24
CN 109865229 A * 6/2019 ..... A62C 27/00

*Primary Examiner* — Steven M Cernoch

(57) ABSTRACT

The present invention relates generally to the technical field of smart home. More particularly, it relates to a sweeping and fire extinguishing device comprising a sweeping robot, a fire extinguishing mechanism and a body frame, wherein said fire extinguishing mechanism is disposed in a space surrounded by the body frame while said sweeping robot is disposed under the fire extinguishing mechanism. Said sweeping robot comprises a body, a processer, an abutting hole and a camera, wherein an abutting terminal is disposed in said abutting hole. Said camera and the abutting terminal are both electrically connected to the processor; Said fire extinguishing mechanism comprises a supporting platform and a clamping mechanism, wherein said supporting platform comprises an abutting block on its lower end and said abutting block comprises a connecting terminal. Said supporting platform comprises a swinging mechanism for placing a fire extinguisher. Said clamping mechanism is disposed on the control handle of the fire extinguisher. Said clamping mechanism is wirelessly connected with the processor; Said body frame comprises a lifting mechanism which is connected with the swinging mechanism. The invention realizes automatic fire extinguishing by integrating the sweeping robot and the fire extinguishing mechanism into a simple structure, which takes up less space and reduces the cost.

1 Claim, 2 Drawing Sheets

(56) References Cited

U.S. PATENT DOCUMENTS

| | | | | |
|---|---|---|---|---|
| 2019/0147715 | A1* | 5/2019 | Noras | G05D 1/0255 701/22 |
| 2019/0240517 | A1* | 8/2019 | Clarke | A62C 3/002 |
| 2020/0216173 | A1* | 7/2020 | Suefuku | B08B 1/04 |

* cited by examiner

SWEEPING AND FIRE EXTINGUISHING DEVICE

TECHNICAL FIELD

The present invention relates generally to the technical field of smart home. More particularly, it relates to a sweeping and fire extinguishing device.

STATE OF THE PRIOR ART

The fire extinguishing devices currently used indoors are special equipment of relatively large size, which has only single functions and occupies much space.

SUMMARY OF THE INVENTION

To solve the problems in the prior art, the present invention provides a sweeping and fire extinguishing device that does not occupy much space.

The invention provides a sweeping and fire extinguishing device, comprising:

A sweeping robot, wherein said sweeping robot comprises a body, a processer, an abutting hole and a camera. Said processer is disposed in said body. Said abutting hole and camera are both disposed on the upper end of said body. An abutting terminal is disposed in said abutting hole. Said abutting terminal and the camera are both electrically connected to the processor;

A fire extinguishing mechanism, wherein said fire extinguishing mechanism comprises a supporting platform and a clamping mechanism. Said supporting platform is provided on its lower end with an abutting block adapted to said abutting hole. Said abutting block is provided with a connecting terminal adapted to said abutting terminal. Said sweeping robot is disposed under said fire extinguishing mechanism. Said supporting platform is provided with a swinging mechanism for adjusting the spraying angle of the fire extinguisher. Said fire extinguisher is disposed in the swinging mechanism. Said clamping mechanism is fixed on the control handle of said fire extinguisher. Said clamping mechanism is wirelessly connected with the processor;

A body frame, wherein said fire extinguishing mechanism is disposed in a space surrounded by the body frame. Said body frame is provided with a lifting mechanism for driving the fire extinguishing mechanism to move up and down. Said lifting mechanism is connected to said swinging mechanism.

As a further improvement of the present invention, said swinging mechanism comprises two supporting plates, a supporting base, two swinging arms, at least one swinging motor for driving the swinging arms to swing, and a retaining ring for fixing the fire extinguisher, wherein the two supporting plates are disposed symmetrically on two sides of the upper end of the supporting platform, and the upper ends of the two supporting plates are respectively provided with a horizontal supporting portion. Said swinging motor is disposed in said supporting portion. The upper ends of the two swinging arms are respectively hinged with said two supporting portions while the lower ends of said two swinging arms are respectively connected to the two ends of said supporting base. Said retaining ring is disposed between the upper ends of the two swinging arms.

As a further improvement of the present invention, said lifting mechanism comprises two longitudinal sliding rails symmetrically disposed on the inner sidewalls of said body frame, sliders disposed on said two longitudinal sliding rails, and a driving mechanism for driving said sliders to move up and down, wherein the ends of said two sliders are provided with limiting slots corresponding to said two supporting portions respectively.

As a further improvement of the present invention, said driving mechanism is a lifting motor or a lifting cylinder.

As a further improvement of the present invention, said clamping mechanism comprises a linear motor, a driving power supply and a clamping circuit board, wherein said linear motor is fixed onto the lower holder of the control handle of said fire extinguisher. The outlet end of said linear motor is provided with a roller wheel. Said roller wheel is mounted on the upper holder of the control handle of said fire extinguisher. Said driving power supply and said linear motor are both electrically connected to said clamping circuit board while said clamping circuit board is wirelessly connected with said processor.

As a further improvement of the present invention, the rear part of the lower end of said body frame is provided with a retaining base adapted to said sweeping robot, wherein the retaining base is provided with a control switch and said control switch is electrically connected to said driving mechanism.

As a further improvement of the present invention, said abutting hole and said abutting block are connected via an automatic limiting lock.

As a further improvement of the present invention, said supporting platform is further provided with a swinging circuit board, wherein said connecting terminal is electrically connected to said swinging circuit board and said swinging motor is electrically connected to the swinging circuit board.

As a further improvement of the present invention, the sweeping robot further comprises a sweeping assembly and a driving wheel, wherein said sweeping assembly and driving wheel are both disposed at the lower end of said body.

As a further improvement of the present invention, said fire extinguisher is a portable fire extinguisher.

The present invention has the beneficial effects that the sweeping and fire extinguishing device of the invention comprises a sweeping robot, a fire extinguishing mechanism and a body frame, wherein the fire extinguishing mechanism can move up and down on the body frame. Under normal circumstances, the sweeping robot is separated from the fire extinguishing mechanism and the sweeping robot realizes its functions of floor sweeping and surroundings monitoring. When fire danger occurs, it will quickly reach the position of the fire extinguishing mechanism and take the fire extinguishing mechanism to complete fire extinguishing. Simple in structure, and safe and reliable in operation, the invention is able to detect fire danger timely and make response promptly, thus effectively avoiding the spread of fire. In addition, the product of the invention has various functions, takes up less space and reduces the cost.

Reference signs: 1—sweeping robot; 11—abutting hole; 12—camera; 21—body frame; 22—supporting platform; 23—supporting base; 24—supporting portion; 25—clamping mechanism; 26—abutting block; 27—retaining ring;

3—lifting mechanism; 31—longitudinal sliding rail; 32—slider; 4—fire extinguisher; 5—retaining base.

DETAILED DESCRIPTION OF PREFERRED EMBODIMENTS

Figure 1:
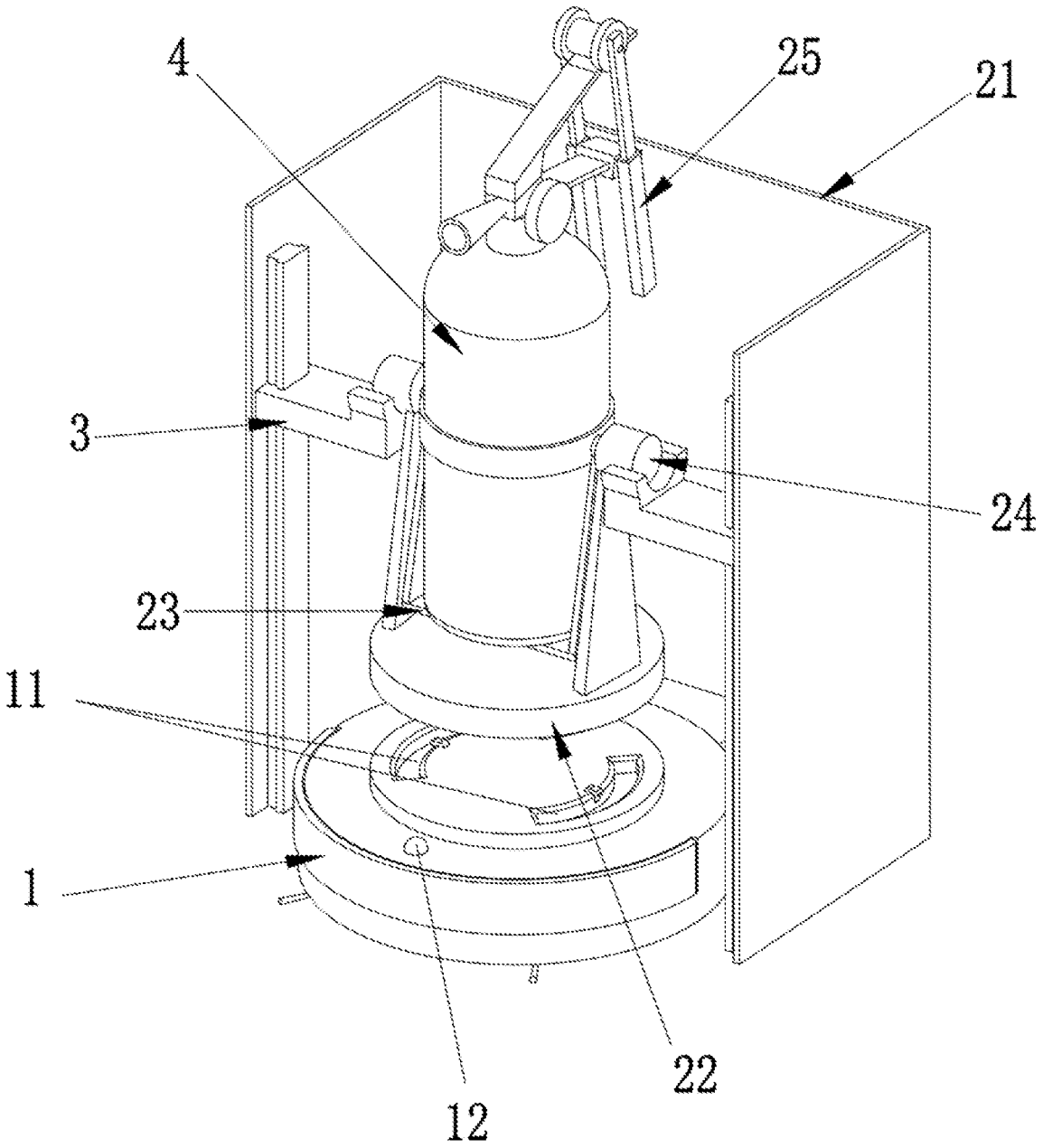
FIG. 1 is a schematic view illustrating the structure of the sweeping and fire extinguishing device of the present invention.
Figure 2:
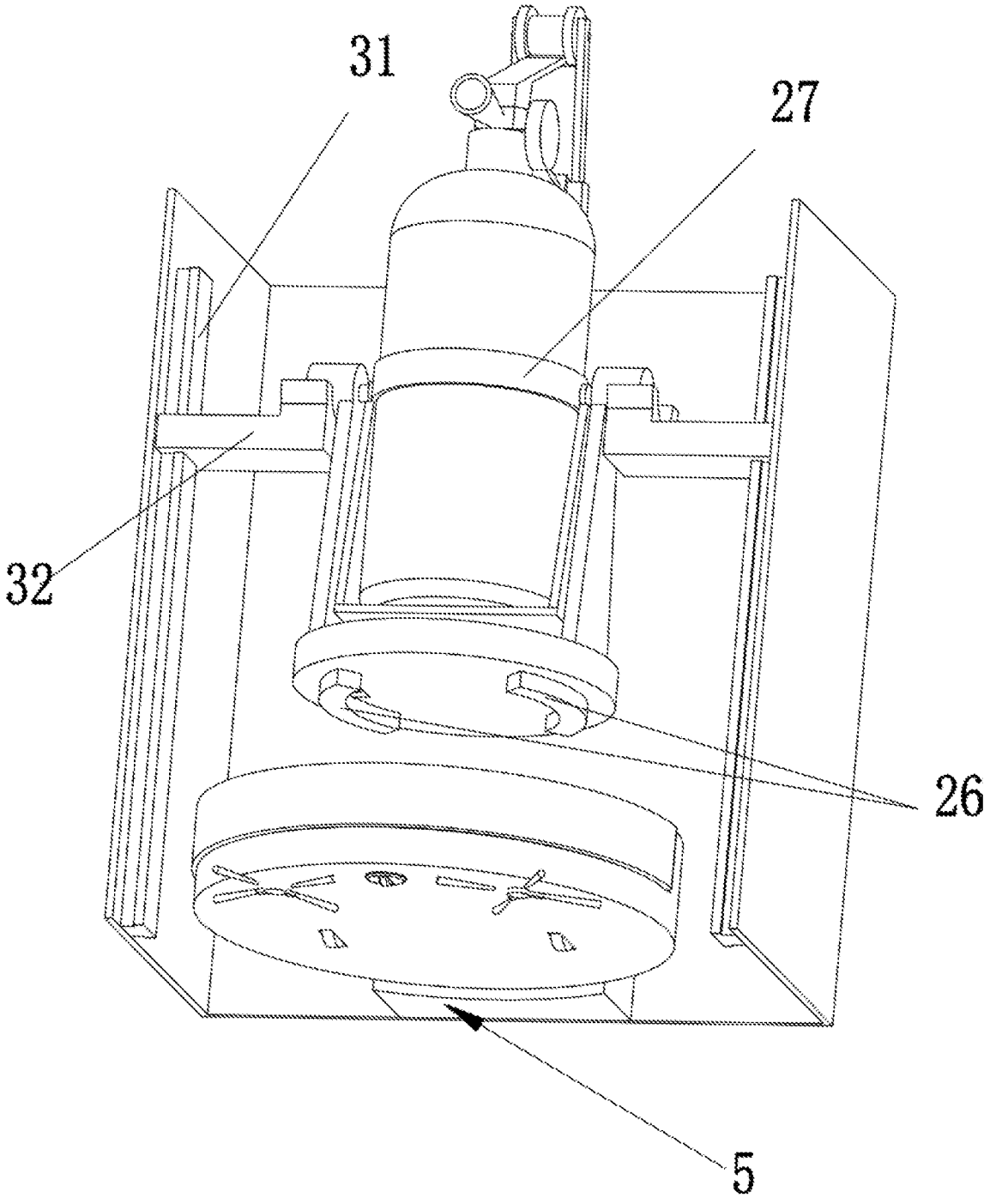
FIG. 2 is a schematic view illustrating the structure of the sweeping and fire extinguishing device of the present invention from another perspective.

As shown in FIG. 1 and FIG. 2, the present invention discloses a sweeping and fire extinguishing device, comprising a sweeping robot 1, a fire extinguishing mechanism and a body frame 21. Said sweeping robot 1 comprises a body, a processor, an abutting hole 11 and a camera 12. Said processor is disposed inside the body. Said abutting hole 11 and the camera 12 are both disposed on the body. Said abutting hole 11 is provided with an abutting terminal. Said camera 12 is a 360° rotating camera which is able to monitor the surroundings better. Said camera 12 and the abutting terminal are electrically connected to the processor. The fire extinguishing mechanism comprises a supporting platform 22 and a clamping mechanism 25. The lower end of the supporting platform 22 is provided with an abutting block 26 adapted to said abutting hole 11. Said abutting block 26 is provided with a connecting terminal adapted to said abutting terminal. Said sweeping robot 1 is disposed under said fire extinguishing mechanism. Said supporting platform 22 is provided with a swinging mechanism for adjusting the spraying angle of a fire extinguisher 4. Said fire extinguisher 4 is disposed in the swinging mechanism. The pitch angle of spraying of the fire extinguisher 4 can be adjusted by the swinging mechanism so as to spray effectively at fire points of different heights. Said clamping mechanism 25 is fixed on a control handle of said fire extinguisher 4. Said clamping mechanism 25 is wirelessly connected with the processor to facilitate the spraying control of the fire extinguisher 4; Said fire extinguishing mechanism is disposed in a space surrounded by the body frame 21. Said body frame 21 is provided with a lifting mechanism 3 for driving the fire extinguishing mechanism to move up and down. Said lifting mechanism 3 is connected to the swinging mechanism.

The sweeping and fire extinguishing device of the present invention comprises a sweeping robot 1, a fire extinguishing mechanism and a body frame 21. Under normal circumstances, the fire extinguishing mechanism and the body frame 21 are connected together while the sweeping robot 1 is separated from the fire extinguishing mechanism. The fire extinguishing mechanism is placed at a fixed position while the sweeping robot 1 is able to clean the room by sweeping the floor. When the camera 12 of the sweeping robot 1 captures a fire point, the processor will analyze the image. Once the fire point is confirmed, it will quickly move to the position under the fire extinguishing mechanism. The lifting mechanism 3 on the body frame 21 drives the fire extinguishing mechanism to descend so that the sweeping robot 1 is connected with the supporting platform 22 of the fire extinguishing mechanism and takes the fire extinguishing mechanism to the fire point for fire extinguishing. The swinging mechanism can adjust the spraying angle of the fire extinguisher 4 according to the different position of the fire point, thus realizing the automatic fire extinguishing function. Simple in structure, and safe and reliable in operation, the invention is able to detect fire danger timely and make response promptly, thus effectively avoiding the spread of fire. Meanwhile, the product of the invention has various functions, takes up less space, reduces the cost and enjoys better versatility as the fire extinguisher 4 can be easily replaced.

In the technical embodiment of the present invention, said swinging mechanism comprises two supporting plates, a supporting base 23, two swinging arms, at least one swinging motor for driving the swinging arms to swing, and a retaining ring 27 for fixing the fire extinguisher, wherein said two supporting plates are disposed symmetrically on two sides of the upper end of the supporting platform 22, and the upper ends of said two supporting plates are respectively provided with a horizontal supporting portion 24. Said swinging motor is disposed in said supporting portion 24. The upper ends of said two swinging arms are respectively hinged with said two supporting portions 24 while the lower ends of said two swinging arms are respectively connected to the two ends of said supporting base 23. Said retaining ring 27 is disposed between the upper ends of the two swinging arms. The pitch angle of the two swinging arms can be adjusted via the swinging motor so as to adjust the spraying angle of the fire extinguisher 4, thus extinguishing fires of different heights effectively.

In the technical embodiment of the present invention, said lifting mechanism 3 comprises two longitudinal sliding rails 31 symmetrically disposed on the sidewalls of said body frame 21, sliders 32 disposed on said two longitudinal sliding rails 31, and a driving mechanism for driving said sliders 32 to move up and down, wherein said two sliders 32 are provided with limiting slots corresponding to said two supporting portions 24 respectively. Said driving mechanism is a lifting motor or a lifting cylinder, which is convenient to control the vertical sliding of the supporting platform 22 and the combination and separation of the fire extinguishing mechanism and the sweeping robot 1.

In the technical embodiment of the present invention, said clamping mechanism 25 comprises a linear motor, a driving power supply and a clamping circuit board, wherein said linear motor is fixed onto the lower holder of the control handle of said fire extinguisher 4. The outlet end of said linear motor is provided with a roller wheel. Said roller wheel is mounted on the upper holder of the control handle of said fire extinguisher 4. Said driving power supply and said linear motor are both electrically connected to said clamping circuit board while said clamping circuit board is wirelessly connected with said processor. The processor can transmit signals to the clamping circuit board via Bluetooth, Wi-Fi or other wireless communication modules so as to control the linear motor, which drives the roller wheel to clamp the upper and lower holders of the fire extinguisher 4 to start the spraying of the fire extinguisher 4. It is easy to control and convenient to be fixed on holders of the portable fire extinguisher 4, which enjoys better versatility as the fire extinguisher 4 can be easily replaced.

In the technical embodiment of the present invention, the receiving space of said body frame 21 is provided with a retaining base 5 adapted to said sweeping robot 1, wherein the retaining base 5 is provided with a control switch and said control switch is electrically connected to said driving mechanism. When the sweeping robot 1 enters the receiving space of the body frame 21 and contacts the retaining base 5, the control switch will be triggered to be turned on and start the driving mechanism so that the supporting platform 22 descends and join with the sweeping robot 1.

In the technical embodiment of the present invention, said abutting hole 11 and said abutting block 26 are connected via an automatic limiting lock, wherein said automatic limiting lock is an automatic snap-fit limiting lock, which is able to lock the fire extinguishing mechanism to the sweeping robot 1

In the technical embodiment of the present invention, said supporting platform 22 is further provided with a swinging circuit board, wherein said connecting terminal is electrically connected to said swinging circuit board and said swinging motor is electrically connected to the swinging circuit board. The swinging circuit board is connected with the abutting terminal of the sweeping robot 1 through a connecting terminal and further connect electrically with the processor, which is convenient and reliable.

In the technical embodiment of the present invention, said sweeping robot 1 further comprises a sweeping assembly and a driving wheel, wherein said sweeping assembly and driving wheel are both disposed at the lower end of said body. Said processor is disposed in said body.

Said fire extinguisher 4 is a portable fire extinguisher which is better in versatility, lower in cost, less in space occupation and easy to replace.

Under normal circumstances, the sweeping robot 1 is separated from the fire extinguishing mechanism. When fire danger occurs, they will integrate with each other to extinguish the fire automatically and promptly. The invention is simple in structure, takes up less space and reduces the cost.

The above is a further detailed description of the present invention in connection with the specific preferred embodiments, which is not intended to limit the specific embodiments of the present invention to the description. It should be understood to those ordinary skilled in the art that extensions or substitutions of the present invention could be made hereto without departing from the spirit and scope of the invention, which shall fall within the scope of the present invention.

The invention claimed is:

1. A sweeping and fire extinguishing device, comprising:

a body frame including a retaining base on a bottom;

a sweeping robot supported by the retaining base and disposed within the body frame, the sweeping robot including two opposite, curved abutting holes on an intermediate portion of a top, and a camera adjacent to an edge of the top;

a supporting platform disposed above the sweeping robot and including an upper supporting base with a fire extinguisher disposed thereon, and two opposite, curved abutting blocks on a bottom, the abutting blocks being moveably disposed in the abutting holes respectively for adjusting a spraying angle of the fire extinguisher;

a clamping mechanism secured to an upper portion of an inner surface of the body frame for holding the fire extinguisher in place; and a lifting mechanism including two longitudinal sliding rails disposed on two opposite sides of the inner surface of the body frame respectively, two opposite sliders moveably disposed on the sliding rails respectively, two opposite support portions each supported by an end of the slider, and a retaining ring secured to the support portions for fastening the fire extinguisher;

wherein the sliders are configured to move along the sliding rails for lifting or lowering the fire extinguisher.

* * * * *